US006269910B1

(12) United States Patent
Fargo et al.

(10) Patent No.: US 6,269,910 B1
(45) Date of Patent: Aug. 7, 2001

(54) ELEVATOR RESCUE SYSTEM

(75) Inventors: Richard N. Fargo, Plainville, CT (US); Gerard Sirigu, Gien (FR); Helmut Schröder-Brumloop, Berlin (DE); Joseph J. Barna, Trumbull; Barry G. Blackaby, Avon, both of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/620,669

(22) Filed: Jul. 20, 2000

Related U.S. Application Data

(62) Division of application No. 09/277,495, filed on Mar. 26, 1999.

(51) Int. Cl.[7] ..... B66B 5/06

(52) U.S. Cl. ..... 187/287; 187/350; 187/290

(58) Field of Search ..... 187/393, 290, 187/298, 287, 288, 250, 350

(56) References Cited

U.S. PATENT DOCUMENTS

| | | | | |
|---|---|---|---|---|
| 3,792,759 | | 2/1974 | Kirsch | 187/29 R |
| 4,284,175 | * | 8/1981 | Ishii et al. | 187/29 R |
| 4,376,471 | * | 3/1983 | Uchino et al. | 187/29 R |
| 4,506,766 | | 3/1985 | Watanabe | 187/29 R |
| 4,533,021 | | 8/1985 | Perez de la Orden | 187/29 R |
| 4,662,478 | | 5/1987 | Uchino | 187/114 |
| 5,492,200 | * | 2/1996 | Korhonen | 187/350 |
| 5,526,902 | | 6/1996 | Gausachs et al. | 187/263 |
| 5,698,823 | | 12/1997 | Tanahashi | 187/296 |
| 5,821,476 | * | 10/1998 | Hakala et al. | 187/290 |
| 5,864,474 | | 1/1999 | Jang | 187/296 |
| 5,896,948 | | 4/1999 | Suur-Askola et al. | 187/290 |
| 5,971,109 | * | 10/1999 | Aulanko et al. | 187/263 |
| 6,021,872 | * | 2/2000 | Sevilleja et al. | 187/350 |
| 6,039,151 | * | 3/2000 | Ringel et al. | 187/207 |
| 6,161,653 | * | 12/2000 | Skalski et al. | 187/305 |

FOREIGN PATENT DOCUMENTS

| | | | |
|---|---|---|---|
| 197 54 034 A 1 | 6/1999 | (DE) | B66B/1/34 |
| 04189284 | 7/1992 | (JP) | B66B/5/02 |

* cited by examiner

*Primary Examiner*—Jonathan Salata

(57) ABSTRACT

An elevator rescue system includes a power source of back-up electrical power. A manually-operated, rescue enable switch switchably permits the transmission of electrical power from the power source to a motor brake coil of an elevator car during a rescue operation such that the energized coil releases the motor brake to move the car to a desired landing. A speed detector measures the speed of the elevator car and thereupon generates a speed control signal corresponding to the speed of the car. An overspeed detection circuit has a first input for being actuated when receiving electrical power from the power source, a second input for receiving the speed control signal, and an output for transmitting electrical power to the motor brake coil when the speed control signal is below a predetermined value and for automatically stopping the transmission of electrical power when the speed control signal becomes higher than a predetermined value. A manually-operated brake release switch has an input and an output. The input is coupled to the output of the overspeed detection circuit, and the output is to be coupled to the motor brake coil of the elevator car for transmitting electrical power to release the motor brake when the brake release switch is closed.

11 Claims, 2 Drawing Sheets

ELEVATOR RESCUE SYSTEM

FIELD OF THE INVENTION

This is a division of copending application Ser. No. 09/277,495 filed Mar. 26, 1999, the contents of which is incorporated herein by reference.

The present invention relates generally to a rescue system, and more particularly to a rescue system for trapped passengers in an elevator car.

BACKGROUND OF THE INVENTION

Elevator rescue systems have been implemented for rescuing trapped passengers from machine-roomless elevator systems. One system involves using levers located remotely in a hallway panel. In machine roomless elevator systems, for example, the levers are connected via a cable to a machine brake located on the elevator machine in the hoistway. The inclusion of a lever, cable, machine interface and installation adds significant cost to the elevator system. Further, such a system relies on either a human operator to regulate the elevator speed, or motor shorting circuitry at additional costs. For example, the human operator must repeatedly release and apply the brake in order to move the elevator car either upwardly or downwardly along the hoistway to the nearest safe elevator landing. In so doing, the human operator must be a highly skilled elevator technician or otherwise careful that the brake is not released for a long enough period of time to enable the elevator car to reach a dangerous speed which can cause serious injury during sudden deceleration of the elevator car when the brake is applied.

It is therefore an object of the present invention to provide an elevator rescue system which avoids the above-mentioned drawbacks associated with prior elevator rescue systems.

SUMMARY OF THE INVENTION

In one aspect of the present invention, an elevator rescue system includes a power source of back-up electrical power. A manually-operated, rescue enable switch switchably permits the transmission of electrical power from the power source to a motor brake coil of an elevator car during a rescue operation such that the energized coil releases the motor brake to move the car to a desired landing. A speed detector measures the speed of the elevator car and thereupon generates a speed control signal corresponding to the speed of the car. An overspeed detection circuit has a first input for being actuated when receiving electrical power from the power source, a second input for receiving the speed control signal, and an output for transmitting electrical power to the motor brake coil when the speed control signal is below a predetermined value and for automatically stopping the transmission of electrical power when the speed control signal becomes higher than a predetermined value. A manually-operated brake release switch has an input and an output. The input is coupled to the output of the overspeed detection circuit, and the output is to be coupled to the motor brake coil of the elevator car for transmitting electrical power to release the motor brake when the brake release switch is closed.

In another aspect of the present invention, an elevator rescue system includes a power source of back-up electrical power. A manually-operated, rescue enable switch switchably permits the transmission of electrical power from the power source to a motor brake coil of an elevator car during a rescue operation such that the energized coil releases the motor brake to move the car to a desired landing. A speed detector measures the speed of the elevator car and thereupon generates a speed control signal corresponding to the speed of the car. An overspeed detection circuit has a first input for being actuated when receiving electrical power from the power source when the rescue enable switch is closed, a second input for receiving the speed control signal, and an output for transmitting electrical power to the motor brake coil when the speed control signal is below a predetermined value and for automatically stopping the transmission of electrical power when the speed control signal becomes higher than a predetermined value. A manually-operated brake release switch has an input and an output. The input is coupled to the output of the overspeed detection circuit, and the output is to be coupled to the motor brake coil of the elevator car for transmitting electrical power to release the motor brake when the brake release switch is closed. A door zone indicator displays when the elevator car is generally level with a desired elevator landing.

DETAILED DESCRIPTION OF THE PREFERRED EMBODIMENT

Figure 1:
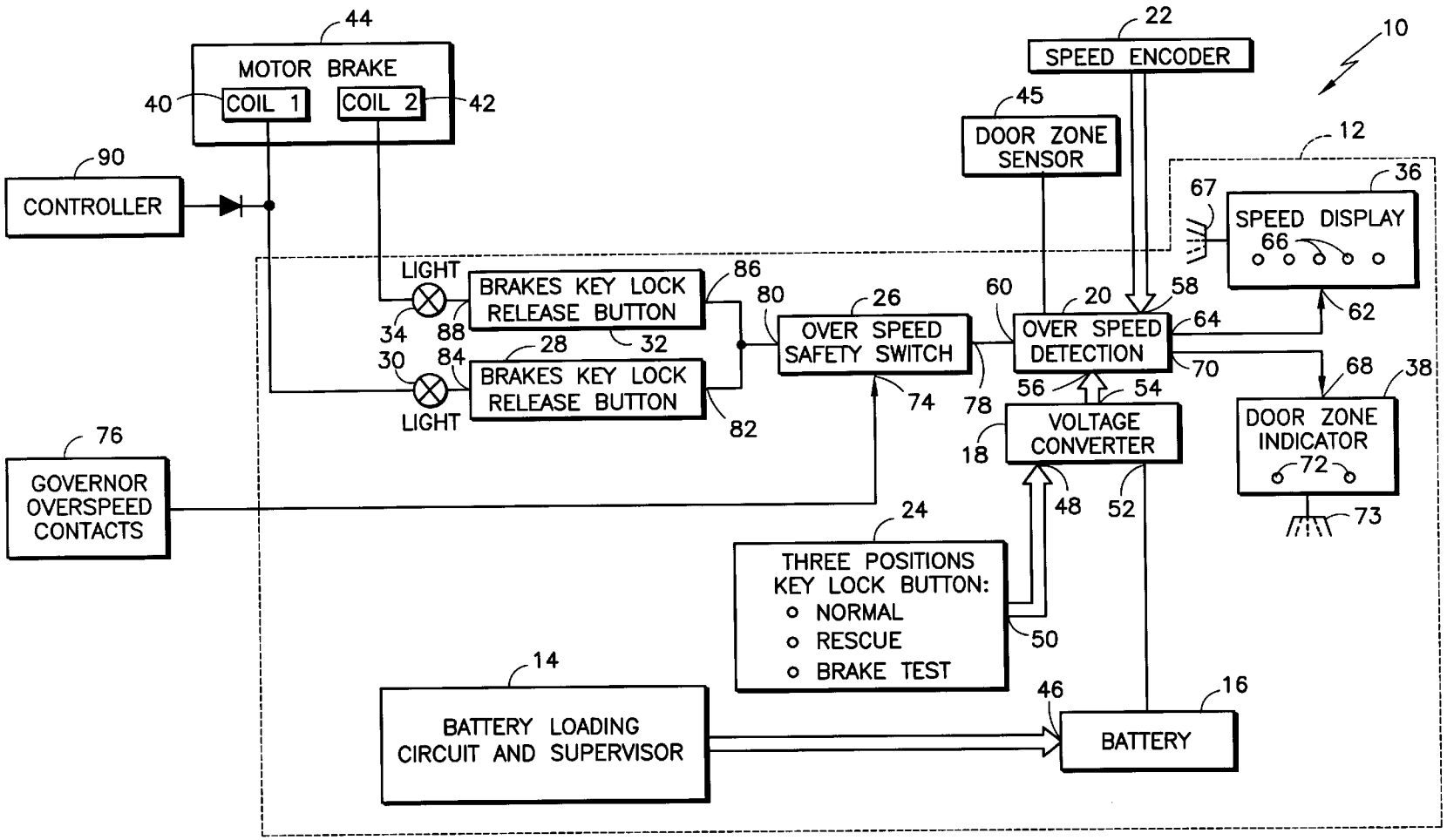
FIG. 1 is a schematic block diagram of an elevator rescue system embodying the present invention.
Figure 2:
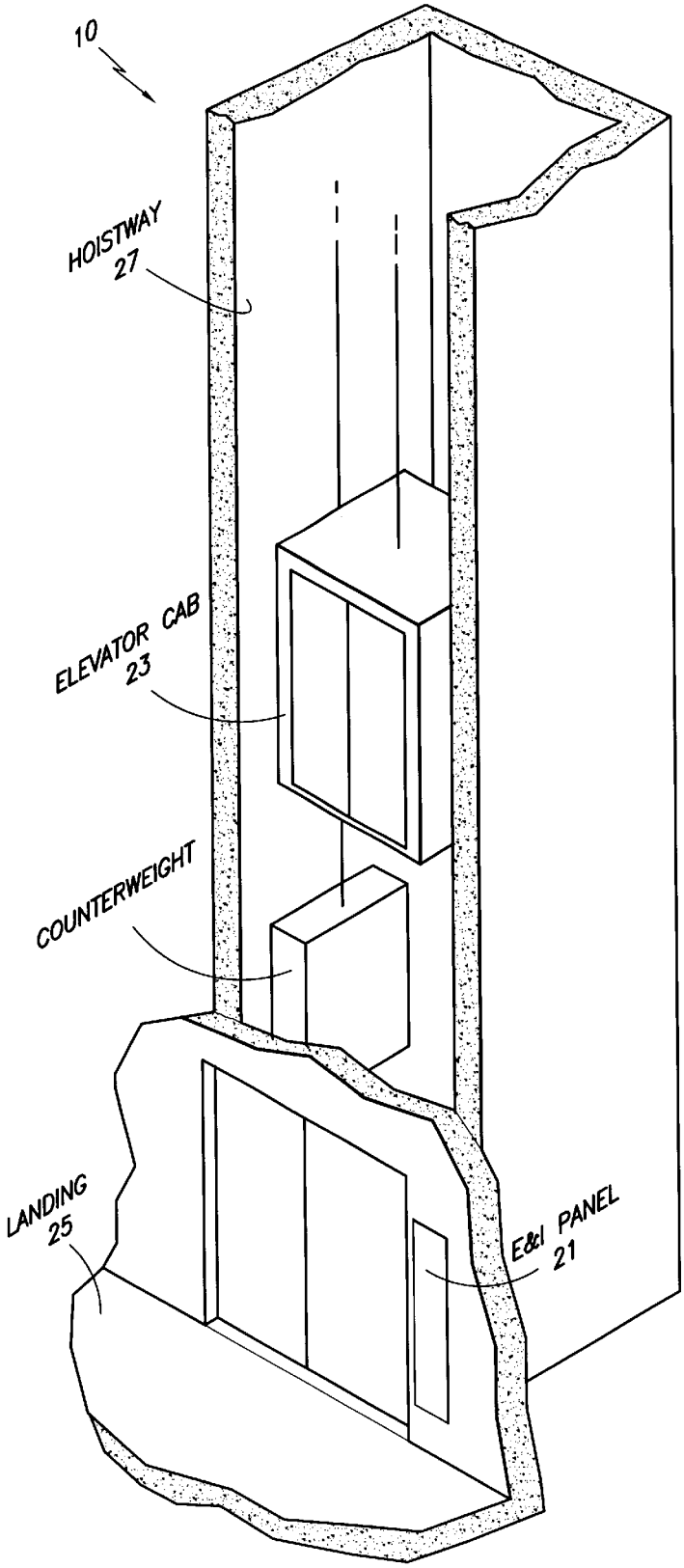
FIG. 2 is a plan drawing of an elevator system embodying the present invention.

Referring to FIG. 1, an elevator rescue system embodying the present invention is generally designated by the reference number 10. The system 10 includes components enclosed by dashed lines 12 which are preferably centrally located in an emergency and inspection (E & I) service panel 21 easily accessible at an elevator landing 25 as shown in FIG. 2.

The system 10 includes a battery loading and supervisor circuit 14, a back up power source 16, such as a DC battery, a voltage converter circuit 18, an overspeed detection circuit 20, a speed encoder 22, a rescue enable switch 24, an optional, overspeed safety switch 26, a first brake release switch 28 and first brake release indicator 30, an optional, second brake release switch 32 and optional, second brake release indicator 34, a speed indicator 36, and a door zone indicator 38. The system 10 permits a first motor brake coil 40 and an optional, second motor brake coil 42 of a motor brake 44 associated with an elevator car 23 to be repeatedly energized and de-energized to move the elevator car 23 to a desired elevator landing 25, preferably the nearest elevator landing 25, during a rescue operation.

The battery loading and supervisor circuit 14 is a conventional loading circuit which receives power from an AC power source, and is coupled to an input terminal 46 of the DC battery 16 for charging and monitoring the battery to ensure that the battery maintains its charge. The battery 16 preferably is a 12 VDC battery having a capacity for supplying converted electrical power of about 1.3 amperes at about 130 volts DC for a total supply time of up to about four minutes over an operation period (i.e. of uninterrupted and interrupted supply of battery power) of about ten minutes.

The rescue enable switch 24 is preferably a manually-operated, three position, key lock button that is switchable among three positions: normal operation, rescue operation, and brake test. The voltage converter circuit 18, preferably a 12_ VDC to 130 VDC voltage converter, includes a first input 48 coupled to an output 50 of the rescue enable switch 24, a second input 52 coupled to an output of the battery 16, and an output 54. The voltage converter circuit 18 is preferably a conventional DC to DC voltage converter which receives a first voltage at its second input 52 and generates a second, relatively higher voltage at its output 54 when the voltage converter circuit is enabled by the rescue enable switch 24.

The overspeed detection circuit 20 is a conventional processor including a first input 56 coupled to the output 54 of the voltage converter circuit 18 for receiving electrical power from the battery which has been converted to the second voltage level suitable for powering the first and second coils 40, 42 of the motor brake 44. The overspeed detection circuit 20 also includes a second input 58 for receiving a speed control signal from the speed encoder 22.

The speed encoder 22 preferably is a speed encoder, but may be substituted by other types of speed detectors. The speed encoder 22 is employed with a conventional elevator machine sheave (not shown) which has an interface where a ring having holes about its diameter (not shown) of, for example, about 120 mm inner diameter and 160 mm outer diameter may be attached to one of the machine sheave flanges for use in providing feedback to the speed encoder. The speed encoder 22 preferably includes a horseshoe shaped sensor for sending two light beams through the holes in the ring. The number of light pulses transmitted through the holes of the ring and received by the speed encoder are used by known methods to determine the position of the elevator car 23 along the hoistway 27. Further, the number of light pulses received by the speed encoder 22 per unit of time may be used by the speed encoder to generate a speed control signal having a signal magnitude corresponding to the speed of the elevator car 23. Alternatively, door zone indicator sensors 45 may be coupled to the overspeed detection circuit 20 to indicate when the elevator car 23 is within the door zone and is flush with the nearest safe landing for disembarkation.

When the overspeed detection circuit 20 receives a speed control signal generated by the speed encoder 22 which is below a predetermined value indicating that the elevator car 23 is either stationary or moving at a safe speed along the hoistway 27 to the desired landing for disembarkation, the overspeed detection circuit passes the electrical power received at its first input 56 to a first output 60. When the speed control signal reaches a predetermined value indicating that the elevator car 23 has reached a first maximum safe speed, such as about 0.63 meters/second, the overspeed detection circuit 20 does not pass the electrical power received at its first input 56 to its first output 60.

The speed indicator 36 has an input 62 coupled to a second output 64 of the overspeed detection circuit 36, and preferably includes a plurality of visual indicators 66, 66, such as light emitting diodes (LEDs) for visually indicating the speed of the elevator car 23. The preferred range of speed covered by the visual indicators is about plus or minus 0.5 meters/second. Preferably, the speed indicator 36 also includes a first alarm 67 for audibly sounding an alarm when the elevator car 23 reaches the first maximum safe speed. For example, a single illuminated visual indicator 66 might correspond to a stationary or slow speed, two illuminated visual indicators 66, 66 might correspond to a slightly faster speed, and so on up to five illuminated visual indicators signifying that the elevator car 23 is traveling at the first maximum safe speed and that the motor brake 44 should be either automatically or manually applied to stop the elevator car 23.

Further, the visual indicators 66, 66 also convey whether the elevator car 23 is moving upwardly or downwardly. For example, a middle visual indicator 66 might be initially lit upon elevator movement. If the elevator car 23 is moving upwardly, the next visual indicator 66 to be lit might be to the right of the center visual indicator 66. Conversely, if the elevator car 23 is moving downwardly, the next visual indicator 66 to be lit might be to the left of the center visual indicator 66. Of course, arranging the visual indicators 66, 66 vertically may be desirable for intuitively showing the direction of elevator car 23 movement.

The overspeed safety switch 26 optionally may be employed as an additional means for preventing the elevator car 23 from passing a second maximum safe speed which is higher than the first maximum safe speed should the overspeed detection circuit 20 fail. The overspeed safety switch 26 includes a control input 74 coupled to conventional governor overspeed contacts 76 already in place in elevator systems. The overspeed safety switch 26 also includes an input 78 coupled to the first output 60 of the overspeed detection circuit 20, and an output 80 for transmitting electrical power to the power brake coils 40, 42 of the motor brake 44 when the overspeed safety switch is in a closed state when the elevator car 23 is traveling below the second maximum safe speed. If the governor overspeed contacts 76 are opened for at least a predetermined time period, such as for example 100 ms, upon the elevator car 23 reaching the second maximum safe speed, the opened governor overspeed contacts 76 cause the overspeed safety switch 26 via its control input 74 to be opened, to thereby cut electrical power to the motor brake coils 40, 42, which in turn de-energizes the motor brake coils to apply the motor brake 44 and stop the elevator car 23. The overspeed safety switch 26 is described in more detail in U.S. Pat. No. 6,186,281 entitled "Remote Storage and Reset of Elevator Overspeed Switch", the disclosure of which is hereby incorporated by reference.

The overspeed safety switch 26 optionally may be employed as an additional means for preventing the elevator car 23 from passing a second maximum safe speed which is higher than the first maximum safe speed should the overspeed detection circuit 20 fail. The overspeed safety switch 26 includes a control input 74 coupled to conventional governor overspeed contacts 76 already in place in elevator systems. The overspeed safety switch 26 also includes an input 78 coupled to the first output 60 of the overspeed detection circuit 20, and an output 80 for transmitting electrical power to the power brake coils 40, 42 of the motor brake 44 when the overspeed safety switch is in a closed state when the elevator car 23 is traveling below the second maximum safe speed. If the governor overspeed contacts 76 are opened for at least a predetermined time period, such as for example 100 ms, upon the elevator car 23 reaching the second maximum safe speed, the opened governor overspeed contacts 76 cause the overspeed safety switch 26 via its control input 74 to be opened, to thereby cut electrical power to the motor brake coils 40, 42, which in turn de-energizes the motor brake coils to apply the motor brake 44 and stop the elevator car 23. The overspeed safety switch 26 is described in more detail in U.S. Pat. No. 6,182,281, and entitled "Remote Storage and Reset of Elevator Overspeed Switch", the disclosure of which is hereby incorporated by reference.

The first brake release switch 28 includes an input 82 coupled to the output 80 of the overspeed safety switch 26, and an output 84 coupled to the first coil 40 of the motor brake 44 via the first brake release indicator 30, such as an LED. Likewise, the second brake release switch 32 includes an input 86 coupled to the output 80 of the overspeed safety switch 26, and an output 88 coupled to the second coil 42 of the motor brake 44 via the second brake release indicator 34, such as an LED. Preferably, the first and second brake release switches 28, 32 are resetable, manually-operated, constant pressure switches which must be manually maintained in a closed position to transmit electrical power from the power source 16 to the first and second motor brake coils 40, 42 of the motor brake 44.

The operation of the present invention embodied in FIG. 1 will now be explained for situations where an elevator car 23 is stopped between floor landings of an elevator hoistway 27 because of a failure of the elevator system, such as, for example, a power failure or broken safety chain. The system 10 of the present invention is typically employed to move the elevator car 23 up to about eleven meters to the nearest safe elevator landing 25. The operation of the present invention is to be implemented when the elevator safeties are operating properly and are not engaged with the elevator rails. If the safety chains are not functioning properly, measures must be taken to ensure that it is safe to move the elevator car 23 including ensuring that all hoistway 27 doors are closed, locked, and marked "out of service". A typical rescue scenario is where an elevator controller 90 for driving the first and second coils 40, 42, or the associated drive hardware or software fails due to circuit failure or power outage to the building housing the elevator system. It is therefore necessary that the system 10 be independent in operation from the elevator controller 90.

In an emergency situation, the rescue enable switch 24 located in the E & I service panel 12 is switched from normal mode to rescue mode in order to actuate the voltage converter 38 via its first input 48 in order to convert the voltage level of the electrical power generated by the power source 16 to a level suitable for energizing the first and second motor brake coils 40, 42. More specifically, the actuated voltage converter 18 receives electrical power at its second input 52 having a first DC voltage level generated from the back-up battery 16 which had been previously charged by the battery loading and supervisor circuit 14 when AC electrical power was available. The electrical power received by the voltage converter 18 is converted to a second DC voltage level that is preferably higher than the first voltage level in order to energize the first and second coils 40, 42 of the motor brake 44. The first and second brake release switches 28, 32 are then manually closed preferably only by maintaining a constant pressure on these switches. Preferably, the first and second brake release switches 28, 32 are in the form of buttons that are operable upon entering a key thereto so that the rescue system 10 is not engagable by unauthorized personnel.

The converted electrical power is received by the overspeed detector circuit 20 at its first input 56. Meanwhile, the speed encoder circuit 22 will typically initially transmit a speed control signal to the second input 58 of the overspeed detection circuit 20 indicating that the elevator car 23 is stationary. Because the speed control signal initially has a value below a predetermined value corresponding to the first maximum safe speed of the trapped elevator car 23, the overspeed detection circuit 20 will pass the electrical power received at its first input 56 to its first output 60. The overspeed detection circuit 20 will also transmit via its second output 64 one or more control signals to the input 62 of the speed indicator 36 for illuminating one or more of the visual indicators 66, 66, the number of visual indicators being illuminated corresponding to the speed of the elevator car 23. Because the speed of the elevator car 23 is initially zero, none or only one of the visual indicators 66 will initially be illuminated. The overspeed detection circuit 20 will also transmit via its third output 70 one or more control signals to the input 68 of the door zone indicator 38 indicating whether the elevator car 23 is in a door zone and whether the elevator car 23 floor is flush with the floor of a desired landing for passenger disembarkation.

The electrical power at the first output 60 of the overspeed detection circuit 20 is transmitted through the overspeed safety switch 26 which is in a closed state during safe elevator speeds. The electrical power is further passed through the first and second brake release switches 32, 34 which are being maintained in a closed state by maintaining pressure on the switches by a human operator. The electrical power is thus transmitted from the power source 16 and through the serially connected components including the voltage converter 18, the overspeed detection circuit 20, the overspeed safety switch 26, and through the first and second brake release switches 28, 32 to energize respectively the first and second motor brake coils 40, 42 to thereby release the motor brake 44 to move the elevator car 23 to the desired elevator landing 25. The first and second brake release indicators 30, 34 are illuminated to indicate that the first and second brake release switches 28, 32 are closed and supplying electrical power to the first and second motor brake coils 40, 42.

If the weight of the elevator car 23 including the passenger weight is higher than that of the elevator counterweight, the elevator car 23 will begin to move downwardly. Conversely, if the weight of the elevator car 23 including the passenger weight is lower than that of the elevator counterweight, the elevator car 23 will begin to move upwardly. Should the weight of the elevator car 23 including the weight of passengers be balanced with that of the counterweight, weight can be added to the elevator car 23 to create an imbalance for moving the car.

As the elevator car 23 begins to move either upwardly or downwardly to the desired elevator landing 25 for disembarkation, the elevator car 23 speed will progressively increase. The speed encoder 22 will detect the speed increase and will continually transmit updated speed control signals to the overspeed detection circuit having a value corresponding to the instantaneous speed of the elevator car 23. The overspeed detection circuit 20 will transmit speed information via its second output 64 to the input 62 of the speed indicator 36 to permit a human operator to determine by means of the number of illuminated visual indicators 66, 66, the present speed of the elevator car 23. The visual indicators 66, 66 provide an additional means for determining whether the system 10 is functioning properly. For example, if all of the visual indicators 66, 66 are illuminated indicating that the elevator car 23 is moving at a maximum safe speed, the human operator may then release pressure from the first and second brake release switches 28, 32 to open these switches and thus open the electrical circuit path from the power source 16 to the first and second motor brake coils 40, 42. With electrical power cut off from the first and second motor brake coils 40, 42, the coils are de-energized resulting in applying the motor brake 44 to stop the elevator car 23.

The overspeed detection circuit 20 will also transmit door zone information via its third output 70 to the input 68 of the door zone indicator 38 to permit a human operator to determine by means of the illuminated visual indicators 72, 72 whether the elevator car 23 is within a door zone of the desired elevator landing 25 for safe disembarkation. For example, one of the visual indicators 72 might be illuminated to indicate that the floor of the elevator car 23 is within a safe distance, such as one or two feet, of the floor of the nearest elevator landing 25, or the other or both of the visual indicators 72, 72 might be illuminated to indicate that the floor of the elevator car 23 is generally flush with the floor of the nearest elevator landing 25 for the safest scenario for passenger disembarkation. When the visual indicators 72, 72 are illuminated, the human operator may then open the first and second brake release switches 28, 32 to de-energize the first and second motor brake coils 40, 42 to thereby apply the motor brake 44 to stop the elevator car 23. The operator may also close the first and second brake release switches 28, 32 to continue moving the elevator to another landing, such as in cases where the first landing is unsafe or where a mechanic needs to move the elevator car 23 to near the top landing in order to gain access to the elevator machine.

Returning now to the scenario where the rescue enable switch 24 is set to the rescue position and the first and second brake release switches 28, 32 are manually maintained in a closed position to supply electrical power to the first and second motor brake coils 40, 42, the speed encoder 22 will generate and transmit generally continuously updated speed control signals to the overspeed detection circuit 20. When the overspeed detection circuit 20 receives a speed control signal having a value indicating that the elevator car 23 has reached the first maximum safe speed, the overspeed detection circuit will not pass electrical power from its first input 56 to its first output 60 to thereby automatically cut electrical power to the first and second motor brake coils 40, 42. The de-energized coils 40, 42 results in applying the motor brake 44 to stop the elevator car 23. Preferably, after a predetermined time period, such as one second, the overspeed detection circuit 20 automatically resets to a state for passing the electrical power to its first output 60 in order to re-energize the first and second brake coils 40, 42 to thereby release the motor brake 44 and begin moving the elevator car 23 further toward the nearest safe landing for disembarkation. A trade-off thus exists between the automatic feature for preventing elevator speed from becoming dangerously high and a smooth ride to the nearest elevator landing 25 because the elevator car 23 may need to be started and stopped several times before reaching the landing.

Should the overspeed detection circuit 20 fail in cutting electrical power to the first and second motor brake coils 40, 42, the elevator car 23 will continue to increase in speed beyond the first maximum safe speed. Should the speed indicator 36 still function properly, the human operator will be able to see from the visual indicators 66, 66 that the elevator car 23 has reached the first maximum safe speed thus informing him to open the first and second brake release switches 28, 32 to cut power to the first and second motor brake coils 40, 42 to thereby apply the motor brake 44 and stop the elevator car 23. Should the speed indicator 36 fail along with the overspeed detection circuit 60, once the elevator car 23 reaches a higher, second maximum safe speed, the governor overspeed contacts 76 forming part of the conventional elevator system will automatically open the overspeed safety switch 26 to cut off electrical power to the first and second motor brake coils 40, 42 so as to apply the motor brake 44 and stop the elevator car 23. Preferably, the overspeed safety switch 26 is resetable in order to resume energization of the first and second motor coils 40, 42.

The rescue system 10 may also be used to test whether a single motor brake shoe associated with a motor brake coil will stop the elevator car 23. In this situation, the rescue enable switch 24 is switched to the brake test position which disables the overspeed detection circuit. The power to the elevator controller 90 is cut, while one of the first and second brake release switches 28, 32 is maintained in a closed state in order to energize a respective one of the motor brake coils 40, 42 and thus maintain one of the brake shoes associated with the coils in a released state in order to determine if only one of the brake shoes is sufficient to stop the elevator car 23 should the other shoe fail.

An advantage of the present invention is that the system 10 uses existing components to provide a low cost, reliable way for safely moving a trapped elevator car 23 to the nearest safe landing for passenger disembarkation.

A second advantage of the present invention is that the overspeed detection circuit is automatic and thus does not rely on human oversight for slowing the elevator car 23 before it reaches an unsafe speed.

A third advantage of the present invention is that the overspeed safety switch 26 provides an additional level of safety should the overspeed detection circuit 20 fail for better ensuring that the elevator car 23 is automatically stopped when reaching maximum safe speeds. Thus experienced elevator technicians need not be called so as to cause delay in freeing trapped passengers. Personnel with little or no elevator technical training, such as a concierge or security guard that is already on-hand, may safely operate the present invention and thereby save valuable time in freeing the passengers.

A fourth advantage of the present invention is that the visual indicators provide yet additional safety by permitting a human operator to manually stop the elevator car 23 upon reaching excessive speed.

A fifth advantage of the present invention is that the system 10 should secure the release of trapped passengers within fifteen minutes of beginning the rescue operation by eliminating the need to contact and wait for the arrival of elevator technicians.

Although this invention has been shown and described with respect to an exemplary embodiment thereof, it should be understood by those skilled in the art that the foregoing and various other changes, omissions, and additions in the form and detail thereof may be made therein without departing from the spirit and scope of the invention. For example, the system may be employed by energizing and de-energizing only one motor coil. The speed and door zone indicators may take other forms such as digital numbers indicating elevator car 23 speed and distance from an elevator landing 25. Further, other speed detectors may be substituted for the speed encoder. Accordingly, the present invention as shown and described in the exemplary embodiment has been presented by way of illustration rather than limitation.

What is claimed is:

1. An elevator rescue system comprising:

a power source;

a switch for permitting the transmission of electrical power from the power source to a brake of the elevator such that the energized brake permits the elevator car to move;

a speed detector that generates a signal corresponding to the speed of the car;

an overspeed detection system that receives the signal and interrupts the power to the brake if the signal indicates that the speed of the car exceeds a predetermined value and;

an overspeed safety switch responsive to a second signal corresponding to the speed of the car, that interrupts the power to the brake if the speed of the car exceeds a second predetermined value.

2. The elevator rescue system according to claim 1, wherein the brake is disposed within an elevator hoistway, and wherein the switch accessible at an elevator landing.

3. The elevator rescue system according to claim 1, wherein the power source is a back-up power source.

4. The elevator rescue system according to claim 3, wherein the back-up power source is a battery.

5. The elevator rescue system according to claim 1 further comprising a door zone indicator for displaying when the elevator car is generally level with a desired elevator landing.

6. The elevator rescue system according to claim 1 wherein the speed detector is a speed encoder.

7. The elevator rescue system according to claim 6 wherein the speed encoder is driven by an elevator machine.

8. The elevator rescue system of claim 7 wherein the second signal is generated by a governor.

9. The elevator rescue system according to claim 1 further comprising an elevator speed indicator coupled to an output of the overspeed detection circuit for indicating when the elevator car reaches a predetermined maximum safe speed.

10. The elevator rescue system of claim 9 wherein the elevator speed indicator further comprises a plurality of visual indicators for indicating when the elevator car reaches the predetermined maximum safe speed.

11. The elevator rescue system of claim 9 wherein the elevator speed indicator further comprises an audible alarm for indicating when the elevator car reaches the predetermined maximum safe speed.

* * * * *